United States Patent [19]

Young et al.

[11] Patent Number: 4,598,828

[45] Date of Patent: Jul. 8, 1986

[54] STORAGE AND DISPENSING RACK

[75] Inventors: Raymond R. Young, Glenview; John F. Deffner, Lisle, both of Ill.

[73] Assignee: Visual Marketing, Inc., Chicago, Ill.

[21] Appl. No.: 468,078

[22] Filed: Feb. 22, 1983

[51] Int. Cl.[4] ..... A47F 1/00

[52] U.S. Cl. ..... 211/59.2; 312/42

[58] Field of Search ..... 211/49 D, 189, 186, 211/2, 71, 74; 312/42, 45, 72; 40/17, 10 R, 18

[56] References Cited

U.S. PATENT DOCUMENTS

| | | | |
|---|---|---|---|
| 1,711,329 | 4/1929 | Short . | |
| 1,813,059 | 7/1931 | Lee | 40/17 |
| 1,864,491 | 6/1932 | Hopp | 40/17 |
| 2,125,557 | 8/1938 | Goldman | 211/74 |
| 2,218,444 | 10/1940 | Vineyard | 211/49 |
| 2,289,751 | 7/1942 | Brenholt | 211/49 |
| 2,492,912 | 12/1949 | Womack | 312/45 |
| 2,623,641 | 12/1952 | Shield | 312/42 X |
| 2,923,212 | 4/1960 | Jacobson | 211/49 |
| 3,019,907 | 2/1962 | Belejack | 211/49 |
| 3,055,293 | 9/1962 | Lariccia | 312/45 X |
| 3,279,618 | 10/1966 | Bergstedt | 211/49 |
| 3,393,808 | 7/1968 | Chichill | 211/49 |
| 3,528,558 | 9/1970 | Williams | 211/49 |
| 3,538,860 | 11/1970 | Fisher | 211/49 D |
| 3,784,022 | 1/1974 | Beesley, Jr. | 211/49 |
| 4,105,126 | 8/1978 | Deffner et al. | 211/49 |
| 4,119,208 | 10/1978 | Acker | 211/49 |
| 4,136,783 | 1/1979 | Karashima | 211/151 X |
| 4,191,296 | 3/1980 | Morgan | 211/49 |
| 4,314,648 | 2/1982 | Spamer | 211/49 |
| 4,356,923 | 11/1982 | Young et al. | 211/49 |
| 4,454,948 | 6/1984 | Spamer | 211/49 D |
| 4,474,297 | 10/1984 | Zucker | 312/45 X |

FOREIGN PATENT DOCUMENTS 2816999 10/1979 Fed. Rep. of Germany .

*Primary Examiner*—Robert W. Gibson, Jr.

*Attorney, Agent, or Firm*—Willian Brinks Olds Hofer Gilson & Lione

[57] ABSTRACT

A storage and dispensing rack for dispensing bottles or cans in an upright position. The rack includes at least two side members interconnected by at least one shelf. The side members include a plurality of apertures in paired, adjacent relationship. The shelves include a plurality of flanges, each flange being removably received by a separate one of adjacent pair of apertures. The shelves are ribbed and constructed from a material with a low coefficient of friction. The side members include a first support edge which is slanted and a second support edge which is not slanted.

3 Claims, 7 Drawing Figures

FIG. 1
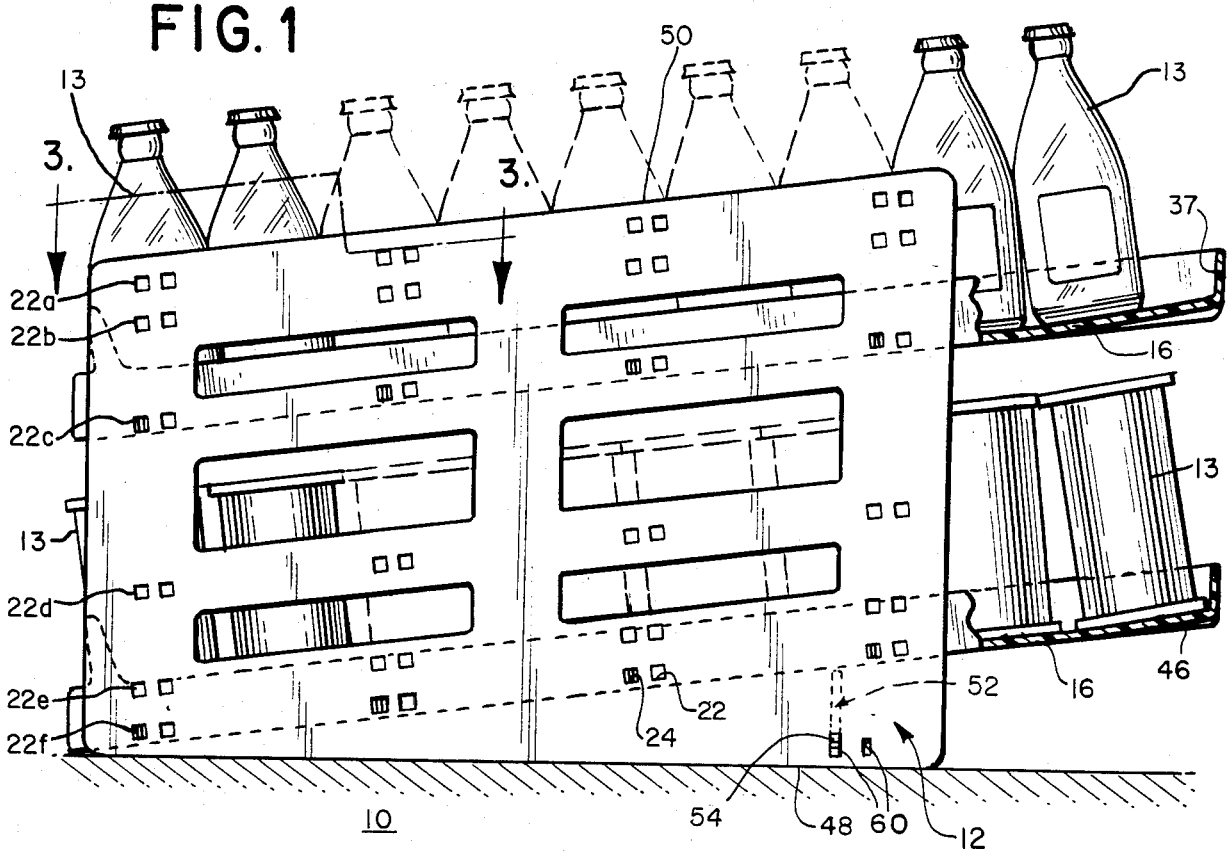
FIG. 1a
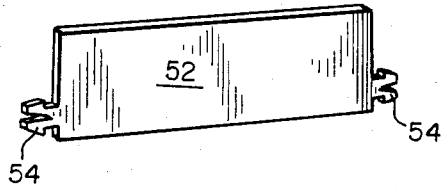
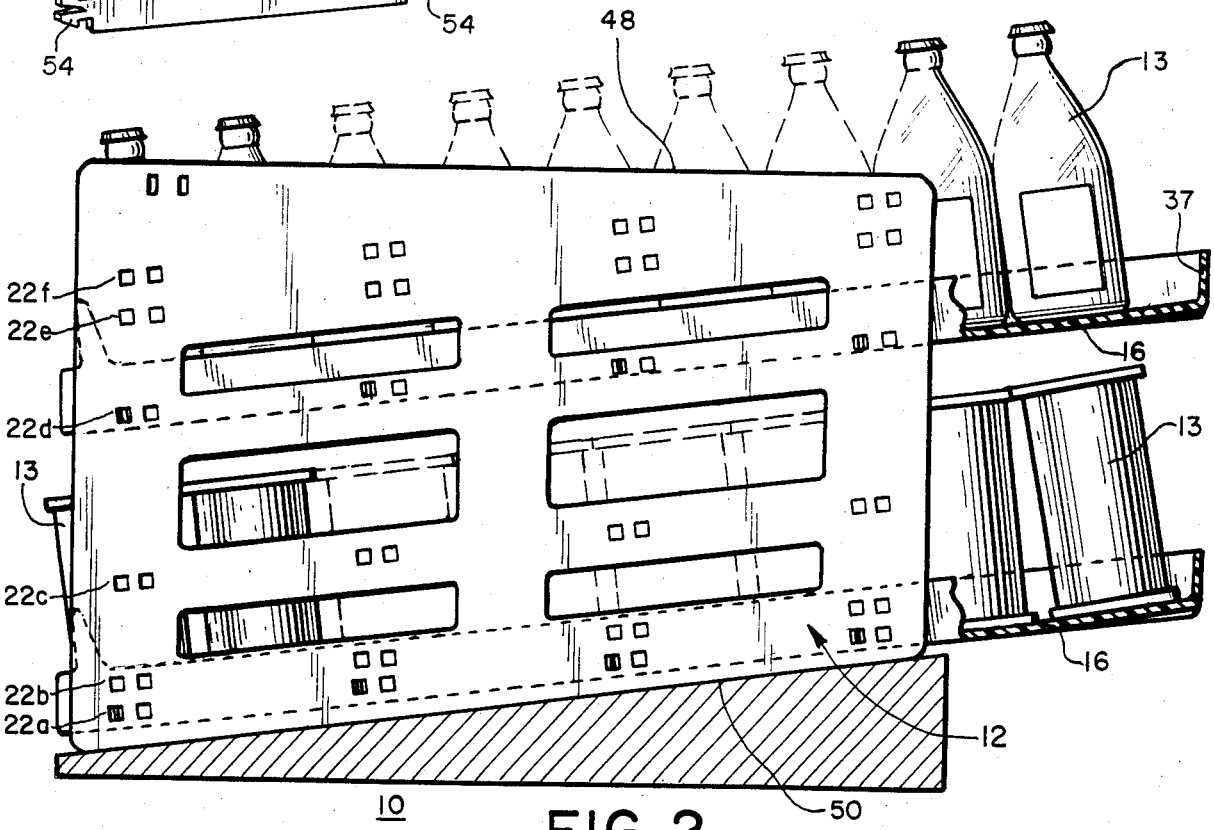
FIG. 2

FIG. 3
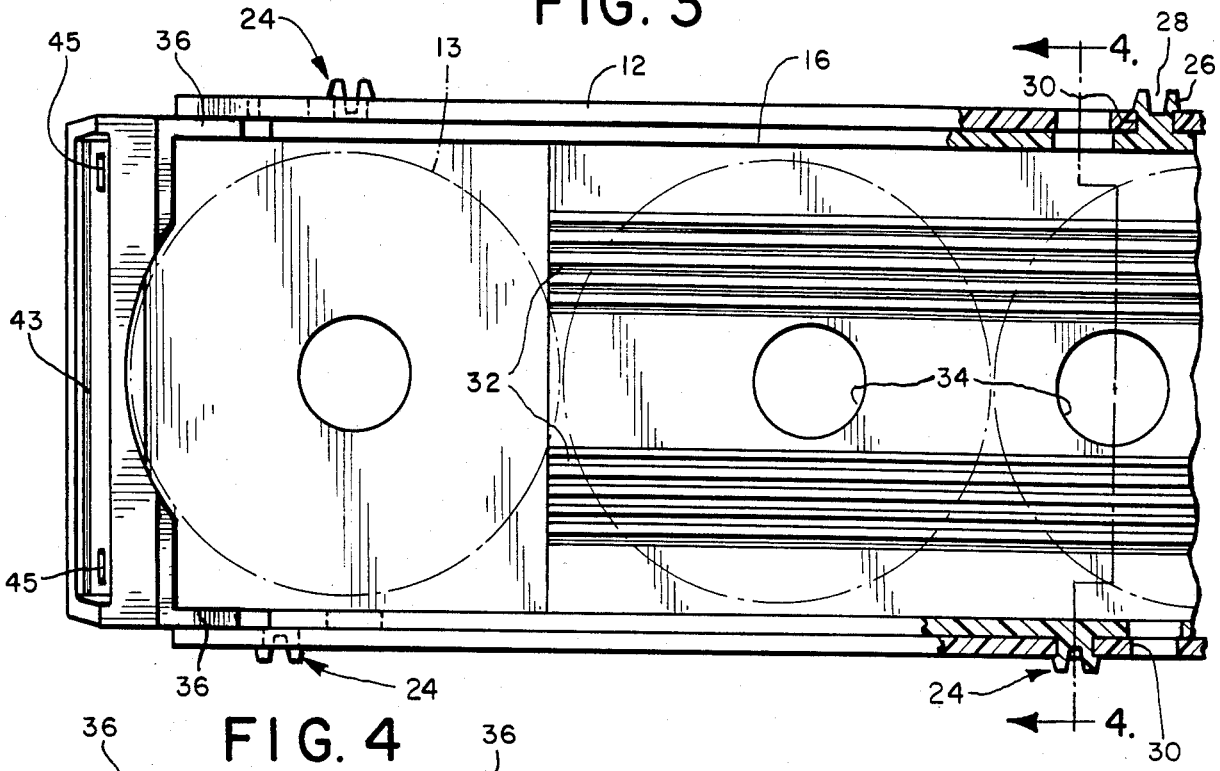
FIG. 4
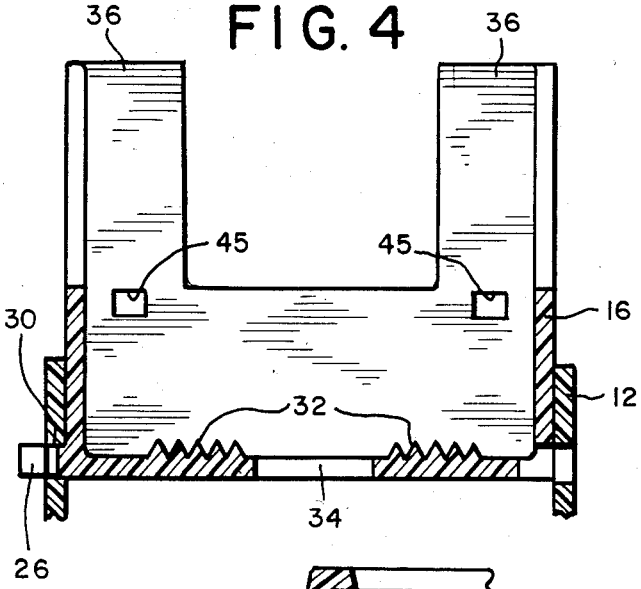
FIG. 5
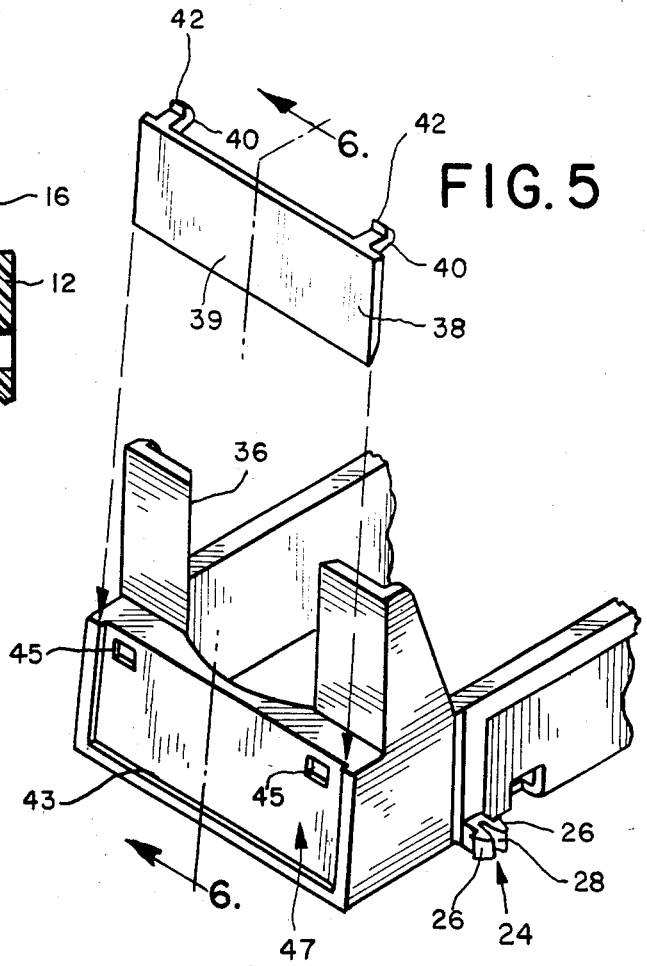
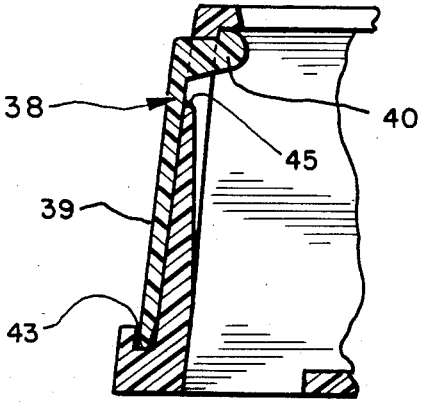
FIG. 6

STORAGE AND DISPENSING RACK

BACKGROUND OF THE INVENTION

The invention relates generally to storage and dispensing apparatus such as used, for example, in supermarkets, merchandising establishments and storage areas in recreation rooms. More particularly, the present invention is directed to an improved rack for storing and dispensing bottles or cans and other generally cylindrical shaped containers, that permits easy assembly and disassembly of the rack.

Storage and dispensing racks for cans and bottles are known in the art. For example, U.S. Pat. Nos. 4,105,126 and 4,356,923, assigned to the assignee of the present invention, describe storage and dispensing racks for dispensing cans or other cylindrical containers. These racks are designed to store and dispense containers which are supported on their sides so that they can roll down an inclined surface to the front of the rack where they are accessible to a customer or user.

The size and shape of some beverage containers makes it undesirable to support these containers on their sides and roll them down an incline. For example, it is not desirable to place glass containers on their sides and roll them to the front on an incline. To accommodate these containers, some storage and dispensing racks are designed to store and dispense containers in an upright position. To this end, these units typically utilize shelves which are inclined sufficiently to cause the container to slide in an upright position. Because of their high center of gravities, some bottles are difficult to dispense from these racks.

Moreover, typically these racks were not versatile. They were usually designed to achieve specific advantages and objects, and were designed to be used on a specifically inclined surface or shelf.

SUMMARY OF THE INVENTION

The present invention is directed to an apparatus for storing and dispensing bottles or cans which overcomes the disadvantages of prior art apparatus. The apparatus includes at least two identical side members which are interconnected by at least one shelf on which the bottles or cans to be dispensed are supported. Each shelf includes a plurality of flanges which are designed to be received within a plurality of apertures located in the side members. The flanges include forked pieces which are designed to snap into the apertures. Once the flanges of the shelves are inserted into the apertures in the side members, they combine with the side members to provide a stable rack constructed from a relatively small number of parts.

The side members are constructed so that they may be supported on either of two edges. One of the edges is slanted so that when the side members are supported on that edge resting on a flat surface the shelves are inclined. The other edge is parallel to the location of the shelf supports so that when the side members are supported on that edge, the shelves will be inclined only to the extent that the surface underneath the edge is inclined.

The shelves include ribbed tracks and are constructed from a material with a coefficient of friction sufficiently low to allow a bottle or can located on the shelves in an upright position to slide from one end of the shelf to the other end when the shelves are inclined at a slope of between approximately 5° to 8°. In a preferred embodiment, the shelves have an inclined rearward portion which causes bottles or cans located on that portion to slide to the front of the shelf.

In a most preferred embodiment of the storage and dispensing rack, a snap-in identification plate is provided. To this end, the shelves have a slotted front portion designed to receive the identification plate and secure it to the front of the shelf.

Accordingly, an advantage of the present invention is to provide a storage and dispensing rack constructed from only two types of components.

A further advantage of the present invention is to provide a storage and dispensing rack which is easily assembled and disassembled.

Another advantage of the present invention is to provide a storage and dispensing rack which may be used on either an inclined surface or a flat surface, and still produce the desired incline of shelf surface.

An additional advantage of the present invention is that the shelves include ribbed tracks that facilitate the movement of a can or bottle from the back of the rack to the front of the rack.

Another advantage of the present invention is that the shelves include a raised rearward portion which causes bottles or cans to move to the front of the shelves.

A further advantage of the invention is to provide an identification plate which is easily received by the front of a shelf.

Another advantage of the present invention is that the shelves are constructed from a material with a coefficient of friction sufficiently low to allow a bottle or can supported in an upright position on the shelves to slide down the inclined shelves.

Additional features and advantages are described in, and will be apparent from, the detailed description of the preferred embodiments and from the drawings.

BRIEF DESCRIPTION OF THE DRAWINGS

FIG. 1 illustrates a side elevation view of a preferred embodiment of the storage and dispensing rack when it is supported on the slanted edge of the side members resting on a flat surface.

FIG. 1*a* illustrates a perspective view of a spacer plate utilized in the storage and dispensing rack of FIG. 1.

FIG. 2 illustrates a side elevation view of a preferred embodiment of the storage and dispensing rack when it is supported on the flat edge of the side members resting on an inclined surface.

FIG. 3 illustrates a cross-sectional view of the storage and dispensing rack of FIG. 1 taken along lines 3—3.

FIG. 4 illustrates a cross-sectional view of the storage and dispensing rack of FIG. 3 taken along lines 4—4.

FIG. 5 illustrates a front perspective view of the front portion of a preferred embodiment of the storage and dispensing rack.

FIG. 6 illustrates a cross-sectional view of the front portion of the storage and dispensing rack of FIG. 5 taken along lines 6—6.

DETAILED DESCRIPTION OF PREFERRED EMBODIMENTS OF THE INVENTION

Referring now to the drawings, there is illustrated a preferred embodiment of the storage and dispensing rack 10 of the present invention, having side members 12 and interconnecting shelves 16. The storage and dispensing rack 10 is designed to accommodate a series of bottles, cans or other containers, hereinafter referred to generally as bottles 13. As will be more fully described below, the storage and dispensing rack 10 is especially designed to accomodate a row of bottles 13 in an upright position. The side members 12 and shelves 16 are the only components necessary in the assembly of the rack 10, and may be used repetitively to form any number of multi-tiered storage and dispensing racks 10 joined in side by side arrangement.

In the preferred embodiment shown in the drawings, two side members 12 and two shelves 16 are provided. The shelves 16 accommodate the bottles 13 in an upright position on an incline and present them for dispensing at the front of the rack 10.

As shown in FIGS. 3 and 4, the shelves 16 interconnect the side members 12 to form the storage and dispensing rack 10. To this end, the shelves 16 are provided with a plurality of flanges 24 which extend from opposing sides of the shelves. Each flange 24 is designed to be received within a corresponding aperture 22 in the side members 12. As shown in FIG. 5, the flanges 24 consist of two forked pieces 26, which define a forked tip 28. The forked pieces 26 can be compressed so that the forked tip 28 snaps into the corresponding aperture 22. The forked pieces 26 include a shoulder portion 30 that cooperates with the side members 12 to securely hold the shelf 16 in place. Thus, the shelves 16 may be snapped into the side members 12 thereby interconnecting the side members to form the storage and dispensing rack 10.

In the preferred embodiment illustrated in FIG. 1, a spacer plate 52 is provided. The spacer plate 52 is designed to be received within apertures 60 in the side members 12. To this end, the spacer plate 52, as illustrated in FIG. 1*a*, includes forked flanges 54 which are received within aperture 60.

The side members 12 are designed so that they may be supported either on a first edge 48 or a second edge 50. The first edge 48 is slanted so that when the side member 12 is supported on the first edge 48 it is inclined, as illustrated in FIG. 1. The second edge 50 is not slanted and therefore when the side member 12 is supported on this edge it is not inclined unless it is supported on a slanted surface as illustrated in FIG. 2.

In the preferred embodiment illustrated, the shelves 16 are provided with four flanges 24 on each side. Correspondingly, the side members 12 are provided with a plurality of rows of apertures 22, with each row containing four paired apertures. The apertures 22 are paired so that shelves 16 may be located on each side of a side member 12 simultaneously.

Referring now to FIG. 1, the apertures 22 of side members 12 are shown. Six rows 22*a–f* of paired apertures 22 are provided. Any row of apertures 22*a–f* may receive the flanges 24 of a shelf 16 depending on how the side members 12 are set up.

In the preferred embodiment illustrated, when the side members 12 are supported on the first edge 48, as illustrated in FIG. 1, the sixth aperture row 22*f* receives flanges 24 of the lower shelf 16. If the side members are both turned 180° i.e., supported on edge 50, as illustrated in FIG. 2, then the first aperture row 22*a* receives the lower shelf 16.

As illustrated in FIG. 1, when the side members 12 are supported on their first edge 48 the third aperture row 22*c* receives the upper shelf 16. As illustrated in FIG. 2, if the side members 12 are turned 180°, i.e., positioned on their second edge 50, then the fourth aperture row 22*d* receives the flanges 24 of the upper shelf 16.

If desired, the upper shelf 16 could be received within the second aperture row 22*b* in the arrangement of FIG. 1 or fifth aperture row 22*e* in the arrangement of FIG. 2. This construction would allow taller bottles 13 to be supported on the lower shelf 16 than those depicted in FIGS. 1 and 2.

The construction of the aperture rows 22*a–f* permits support of the side members 16 on either the first edge 48 or second edge 50. Because the first edge 48 of the side members 12 is slanted when the storage and dispensing rack 10 is supported on this edge on a flat surface, the shelves 16 are thereby inclined. In a most preferred embodiment, the first edge 48 is slanted so that the slope of the incline is between approximately 5° to 8°. This slope provides a sufficient incline to urge the bottles 13 supported on the shelf 16 towards the front stop members 36 of the shelf 16 where they are accessible to the user.

The second edge 50 of the side member 12 is not slanted. Thus, when the storage and dispensing rack 10 is placed on the second edge 50, the shelves 16 located therebetween are likewise not inclined. This allows the storage and dispensing rack 10 to be located on an inclined surface. If the rack 10 was supported on slanted edge 48 on an inclined surface the rack 10 might be inclined at too great a slope.

The shelves 16 include ribbed tracks 32. The ribbed tracks 32 provide a slidable surface for the bottles 13 to be dispensed. As shown in FIG. 3, in a most preferred embodiment, two sets of parallel ribbed tracks 32 are provided. This construction permits room for ventilation holes 34 in the shelves 16 between the tracks 32 while at the same time providing a shelf 16 which will allow the bottles 13 to slide down the shelf in an upright position.

As illustrated in FIGS. 1 and 2, the shelf members 16 include a rearwardly located inclined portion 46. The inclined portion 46 provides an impetus to cause bottles 13 positioned on it to slide towards the front of the shelf 16. It has been found that an inclined portion 46 with a slope of approximately 7° is sufficient to cause a bottle to slide towards the front of the shelf 16.

To further facilitate the dispensing of bottles 13, the shelves 16 are constructed from a material with a low coefficient of friction. In a preferred embodiment, the shelves 16 are constructed from a hi-impact polystyrene mixed with a silicone carrier. The side members 12 are preferably constructed from a hi-impact polystyrene.

In order to provide a rack 10 which displays and dispenses bottles 13 for removal, but does not permit them freely to slide off the inclined shelves 16, a front stop 36 is provided. The front stop 36 permits each bottle 13 to be retained, displayed, and easily accessible to the user. To prevent bottles 13 from falling from the rear of the rack 10 when it is being loaded from the front of the rack 10 a rear stop 37 is provided.

Referring now to FIGS. 5 and 6, a further feature of the present invention is a snap-in identification plate 38. The identification plate 38 is designed to be located on the front of shelf 16. The identification plate 38 identifies the type of product and/or brand in the shelf 16, and to this end, includes a face 39, on which the identification, such as brand name, can be applied. The plate 38 further includes two flanges 40, which extend away from and perpendicular to the face 39 of the plate 38 and include hook portions 42.

As illustrated in FIG. 5, the front 47 of the shelf 16 is designed to securely position the identification plate 38. To this end, the front 47 of the shelf 16 includes a slotted bottom portion 43 and slots 45. The slots 45 are designed to receive the flanges 40 while allowing a portion of the face 39 to be received within the slotted bottom portions 43. The plate 38 is thereby designed to snap into the slots 45 and bottom portion 43. The flanges 40 and hook portion 42 cooperate with the front 47 of the shelf 16 so that the identification plate 38 is securely positioned on the front of the shelf 16.

While only two side members 12 are illustrated in the drawings, any number of side members may be placed in side by side relationship by utilizing the unused apertures 22 to form a modular, repeating storage and dispensing rack.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A rack for storing and dispensing individual containers of a generally cylindrical shape, including glass containers, said rack comprising:

two identical side members, each side member including a plurality of apertures, a first support edge, and a second support edge which is slanted in relation to said first support edge;

at least one shelf, said shelf including means for removably engaging said apertures on said side members so that said side members support said shelf and said shelf cooperates with said side members to support cylindrical containers in an upright position;

a first row of said apertures positioned on each of said side members so that, when said first support edges rest on an inclined surface, said shelf assumes a slanted orientation with respect to a level surface, thereby allowing the containers on said shelf to slide to the lowest end of said shelf;

a second row of said apertures positioned on each of said side members so that, when said second support edges rest on a level surface, said shelf maintains a slanted orientation with respect to the level surface, thereby allowing the containers on said shelf to slide to the lowest end of said shelf;

said shelf further including a front portion having first and second slots and a channel positioned below said slots; and an identification plate having a lower edge and first and second hooks appended to an upper edge, said first and second hooks engaging said first and second slots and said lower edge of said identification plate snapping into said channel to secure said identification plate to said front portion.

2. A rack for storing and dispensing individual containers of a generally cylindrical shape, including glass containers, said rack comprising:

two identical side members, each side member including a plurality of rows of apertures, a first support edge, and a second support edge which is slanted in relation to said first support edge;

a first shelf including means for removably engaging said apertures on said side members so that said side members support said first shelf and said first shelf cooperates with said side members to support cylindrical containers in an upright position;

a first row of said apertures positioned on each of said side members parallel to said first support edge so that, when said first support edges rest on an inclined surface, said first shelf assumes a slanted orientation with respect to a level surface, thereby allowing the containers on said first shelf to slide to the lowest end of said first shelf;

a second row of said apertures positioned on each of said side members so that, when said second support edges rest on a level surface, said first shelf assumes a slanted orientation with respect to the level surface, thereby allowing the containers on said first shelf to slide to the lowest end of said first shelf;

said first shelf further including means for retaining containers at the lowest end of said first shelf and a rear portion which is inclined so that when said first shelf is inclined said rear portion provides additional impetus to urge containers on said first shelf to slide to the lowest end of said first shelf;

third, fourth, fifth and sixth rows of said apertures positioned on each of said side members for supporting a second shelf, identical to said first shelf, said third and fifth rows being parallel with said first row and vertically displaced from said first row and each other, and said fourth and sixth rows being parallel with said second row and vertically displaced from said second row and each other;

said first shelf and said second shelf further including a front portion having first and second slots and a channel positioned below said slots; and an identification plate having a lower edge and first and second hooks appended to an upper edge, said first and second hooks engaging said first and second slots and said lower edge of said identification plate snapping into said channel to secure said identification plate to said front portion.

3. A rack for storing and dispensing individual containers of a generally cylindrical shape, including glass containers, said rack comprising:

a plurality of identical side members, each side member including a plurality of rows of apertures in paired, adjacent relationships, a first support edge, and a second support edge which is slanted in relation to said first support edge;

a plurality of identical shelves, each shelf including means for removably engaging said apertures on two of said side members so that each said shelf is supported by two of said side members and each said shelf cooperates with two of said side members to support cylindrical containers in an upright position, wherein said engaging means includes a plurality of flanges integral with each said shelf, the flanges on one side of said shelf positioned to align with one of said paired apertures on one side member and the flanges on the other side of said shelf positioned to align with the other of said paired apertures on another side member, whereby said shelves can be simultaneously mounted on opposite sides of each said side member at common levels;

a first row of said paired apertures positioned on each of said side members parallel to said first support edge so that, when said first support edges rest on an inclined surface, each said shelf supported by said first row of apertures assumes a slanted orientation with respect to a level surface, thereby allowing the containers on said shelf to slide to the lowest end of said shelf;

a second row of said paired apertures positioned on each of said side members so that, when said second support edges rest on a level surface, each said shelf supported by said second row of apertures assumes a slanted orientation with respect to the level surface, thereby allowing the containers on said shelf to slide to the lowest end of said shelf; and each said shelf further including means for retaining containers at the lowest end of said shelf and a rear portion which is inclined so that when said shelf is inclined said rear portion provides additional impetus to urge containers on said shelf to slide to the lowest end of said shelf;

each said shelf further including a front portion having first and second slots and a channel positioned below said slots; and an identification plate having a lower edge and first and second hooks appended to an upper edge, said first and second hooks engaging said first and second slots and said lower edge of said identification plate snapping into said channel to secure said identification plate to said front portion.

* * * * *